US007607955B2

(12) United States Patent
Hill et al.

(10) Patent No.: US 7,607,955 B2
(45) Date of Patent: Oct. 27, 2009

(54) SLIP FIT ELECTRICAL CONNECTOR

(75) Inventors: Lewis Hill, Odessa, FL (US); Nick Moraitis, Ozona, FL (US)

(73) Assignee: Polaris Sales Co., Inc., Odessa, FL (US)

( * ) Notice: Subject to any disclaimer, the term of this patent is extended or adjusted under 35 U.S.C. 154(b) by 0 days.

(21) Appl. No.: 11/671,502

(22) Filed: Feb. 6, 2007

(65) Prior Publication Data

US 2008/0188140 A1 Aug. 7, 2008

(51) Int. Cl.
*H01R 11/09* (2006.01)

(52) U.S. Cl. ..... 439/798; 439/810

(58) Field of Classification Search ..... 439/798, 439/797, 810, 814, 811, 817
See application file for complete search history.

(56) References Cited

U.S. PATENT DOCUMENTS 4,214,806 A * 7/1980 Kraft ..... 439/620.21
6,579,131 B1 * 6/2003 Ashcraft et al. ..... 439/798
6,769,941 B2 * 8/2004 Norden ..... 439/798
6,939,183 B2 * 9/2005 Ferretti et al. ..... 439/798
7,014,514 B2 * 3/2006 Zahnen ..... 439/798
2007/0026745 A1 * 2/2007 Ferretti ..... 439/814

* cited by examiner

*Primary Examiner*—Truc T Nguyen
*Assistant Examiner*—Xuong M Chung-Trans
(74) *Attorney, Agent, or Firm*—Ronald E. Smith; Smith & Hopen, P.A.

(57) ABSTRACT

An electrical connector for transformer studs accommodates two different size transformer studs, at different times, in a slip-fit blind bore. A large circular bore is threaded and oversized for a slip fit of a stud of the largest size with ample clearance space to facilitate placement of the large stud in the bore. A smaller threaded recess is created by an arc formed in a periphery of the large circular bore and is sized to fit a smallest stud. A set screw holds the smaller stud in the threaded recess or the larger stud in the large circular bore. The matching threads provide an effective, efficient, long-lasting, and sturdy electrical transformer connection.

2 Claims, 4 Drawing Sheets

SLIP FIT ELECTRICAL CONNECTOR

BACKGROUND OF THE INVENTION

1. Field of the Invention

This invention relates to electrical connectors for transformers. More particularly, it relates to a slip fit electrical connector that is compatible with transformer studs having different diameters.

2. Description of the Prior Art

Conventional multiple stud transformer connections that can accommodate only two (2) studs require multiple machining operations. Thus there is a need for a transformer connection that accommodates two (2) studs of different sizes but which requires fewer manufacturing operations to manufacture.

U.S. Pat. No. 6,579,131 to Ashcroft discloses a small stud seat within a small bore having a first center, and a larger stud seat within a medium-sized bore having a second center that is offset from the first center. A third bore is larger in diameter than the small and medium-size bores and has a third center offset from the first and second centers of the two (2) smaller bores. The sole function of the large bore is to provide clearance space. The large bore is unthreaded to permit a connector to be quickly slipped over a threaded stud regardless of size when jam screws are retracted. In other words, the Ashcroft structure can accommodate two (2) stud sizes but such accommodation requires the machining of three (3) eccentric bores, two (2) of which are threaded.

What is needed, then, is a slip fit electrical connector that can accommodate two (2) stud sizes but which does not require the machining of three (3) eccentric bores of progressively larger sizes.

However, in view of the art considered as a whole at the time the present invention was made, it was not obvious to those of ordinary skill in this art how the identified needs could be met.

SUMMARY OF INVENTION

The long-standing but heretofore unfulfilled need for a slip fit electrical connector that can handle two (2) studs of differing diameters at different times but which requires fewer machining steps than the connectors of the prior art is now met by a new, useful, and nonobvious invention.

The novel stud mount transformer connector includes an elongate lug of solid construction. A plurality of conductor channels is formed in the elongate lug in transverse relation to a longitudinal axis of the elongate lug. The conductor channels are longitudinally spaced apart with respect to one another. A plurality of set screw channels are also formed in the elongate lug. The set screw channels are also longitudinally spaced apart with respect to one another and the number of set screw channels matches the number of conductor channels. The set screw channels are disposed in intersecting relation to the conductor channels.

An internally threaded, longitudinally-extending circular blind bore is also formed in the elongate lug.

A threaded recess is formed in a periphery of the circular blind bore. This threaded recess or circular arc has a radius that corresponds to a radius of a first transformer stud. The externally threaded first transformer stud screw-threadedly engages the internally threaded circular arc along the bottom of the first transformer stud. A jam or set screw bears down on the top of the first transformer stud to hold it in its operative engagement with the circular arc. An imaginary longitudinal axis of the set screw bisects the circular arc, i.e., the longitudinal axis of the set screw and the mid-point of the circular arc are diametrically opposed to one another.

The circular blind bore intersects the circular arc at a first end of the circular arc and at a second end of the circular arc. The circular blind bore has a diameter sufficient to accommodate a second transformer stud having a diameter greater than a diameter of the first transformer stud and to have excess space around said second transformer stud so that the second transformer stud may be easily positioned in the bore when the set screws are retracted.

The external threads of the second transformer stud screw-threadedly engage the internal threads of the circular blind bore where said internal threads meet the first and second ends of the circular arc. The external threads of the second transformer stud gradually disengage therefrom because the circular blind bore has a diameter greater than the diameter of the second transformer stud. The second transformer stud does not contact or screw threadedly engage the circular blind bore at any points other than near said first and second ends of the circular arc.

The second transformer stud is held in registration with said first and second ends of said circular arc by a set screw disposed in a set screw channel that intersects the circular blind bore. The longitudinal axis of the set screw bisects the circular arc.

Accordingly, only two machining steps are required to form the circular blind bore. The two machining steps include a first step to form the circular blind bore and a second step to form the circular arc or threaded recess in the periphery of the circular blind bore. The first externally threaded stud screw threadedly engages the threaded recess or circular arc and the opposite ends of the circular arc forms a stud seat for the second externally threaded stud having a diameter greater than that of the first stud.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
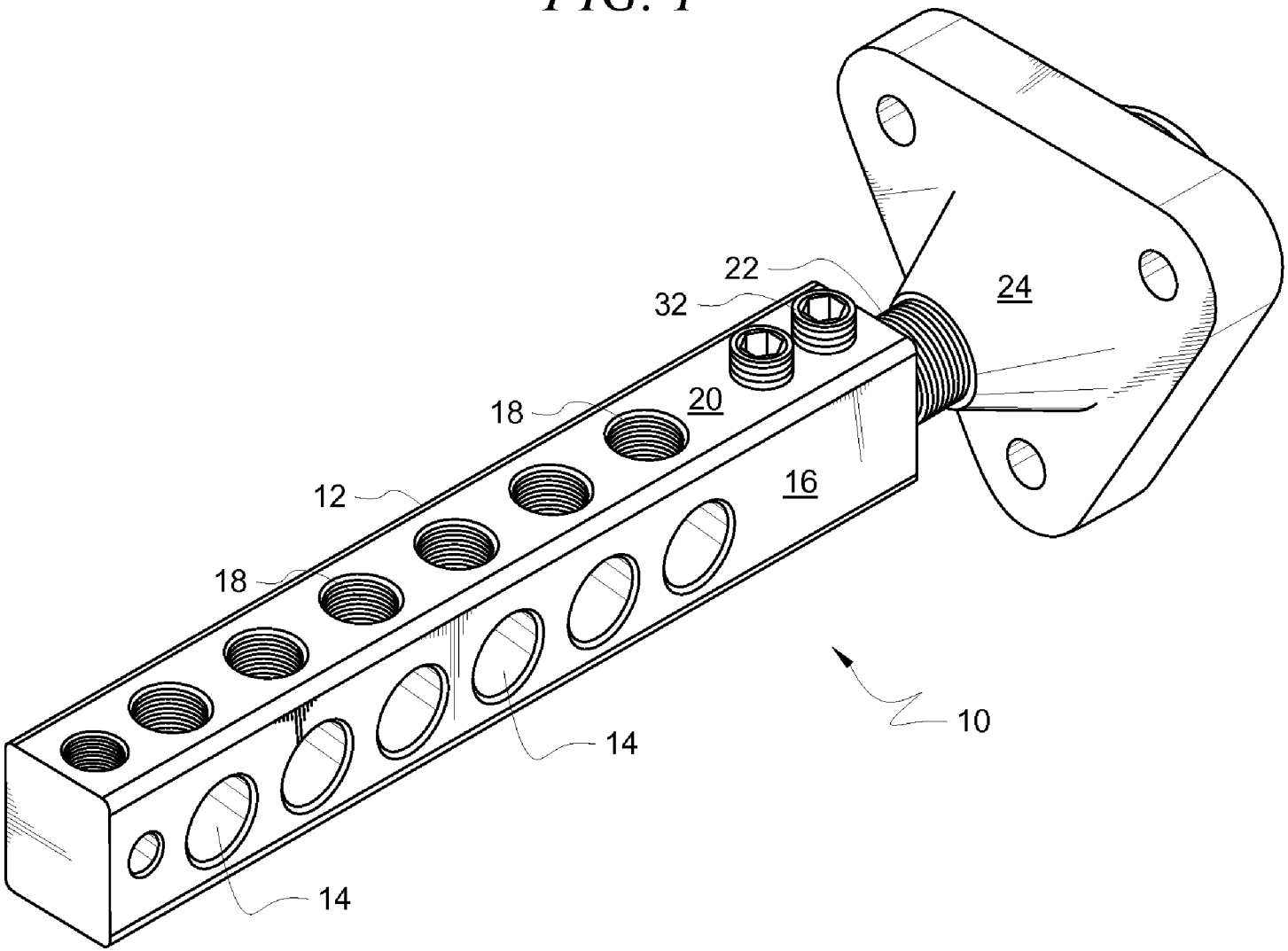
FIG. 1 is a perspective view of a first illustrative embodiment of the invention.

Referring now to FIG. 1, it will there be seen that the novel stud connector is denoted as a whole by the reference numeral 10.

In the embodiment of FIG. 1, lug body 12 has a straight configuration. A plurality of conductor-receiving channels having a common diameter, collectively denoted 14, are formed in a sidewall 16 of said lug body 12 in equidistantly spaced relation to one another along the extent thereof. A plurality of set or jam screw-receiving channels having a common diameter, collectively denoted 18, are formed in a top wall 20 of said lug body 12 in intersecting relation with said conductor-receiving channels. Both the conductor-receiving channels and the set screw-receiving channels are formed transversely relative to the longitudinal axis of lug body 12.

An elongate circular blind bore that is internally threaded, not depicted in FIG. 1, is formed in coincidence with the longitudinal axis of lug body 12. It has a diameter greater than externally threaded transformer stud 22. Therefore, transformer stud 22 may be inserted into said blind bore in the absence of screwthreaded engagement. Transformer stud 22 is secured at its base by boss 24 which mounts to a part of a transformer, not shown. It is therefore understood that transformer stud 22 cannot rotate and that lug body 12 is rotated relative to transformer stud 22 to tighten a screwthreaded connection between said transformer stud 22 and connector 10. Said screwrhreaded connection is made after said transformer stud 22 is inserted into the blind bore in said absence of screwthreaded engagement.

Figure 2:
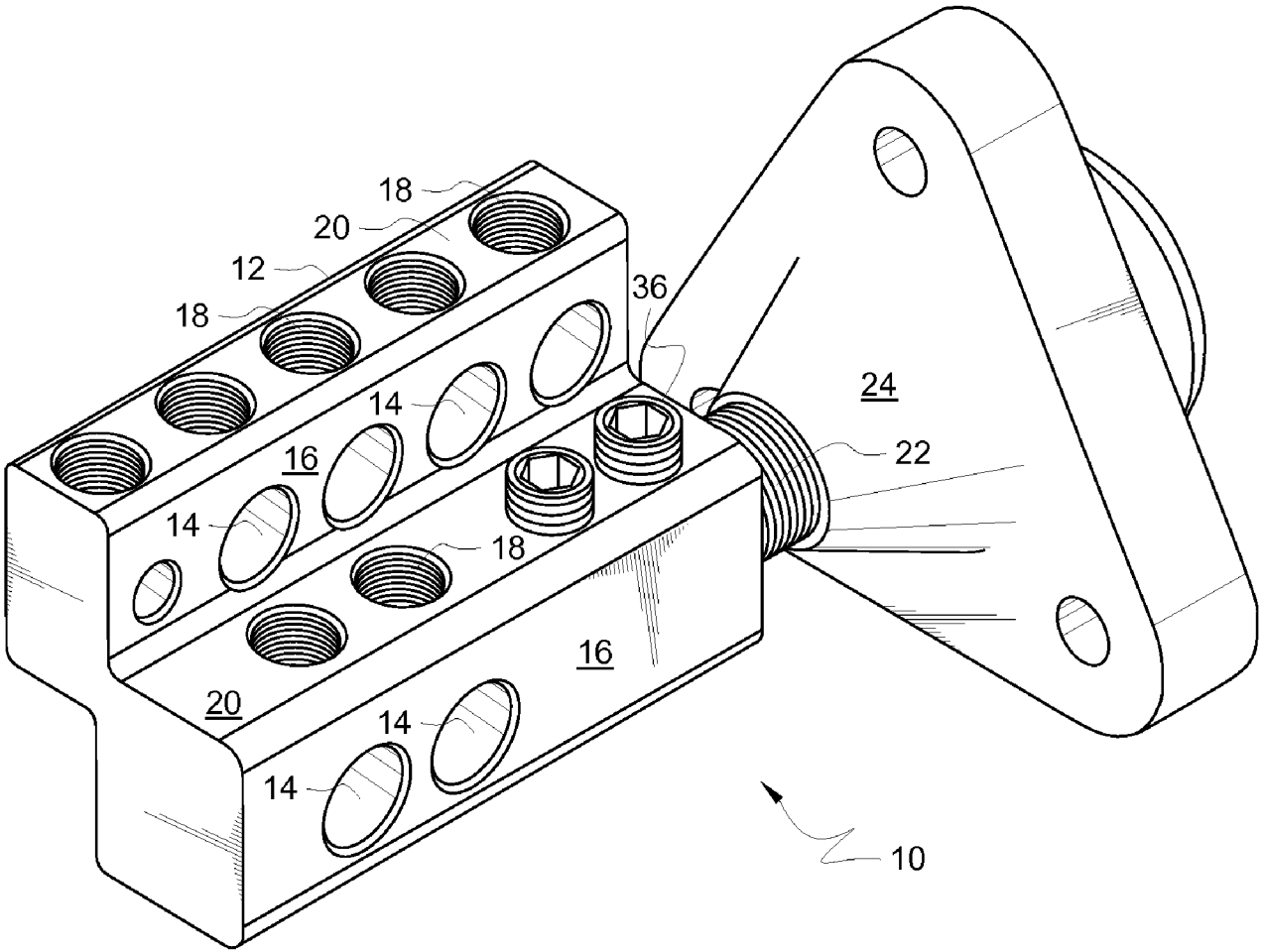
FIG. 2 is a perspective view of a second illustrative embodiment of the invention.

FIG. 2 also depicts a stud-mounted transformer connector, but this particular embodiment has a two-tier arrangement to double the amount of conductors that may be accommodated without increasing the length of lug body 12.

Figure 3:
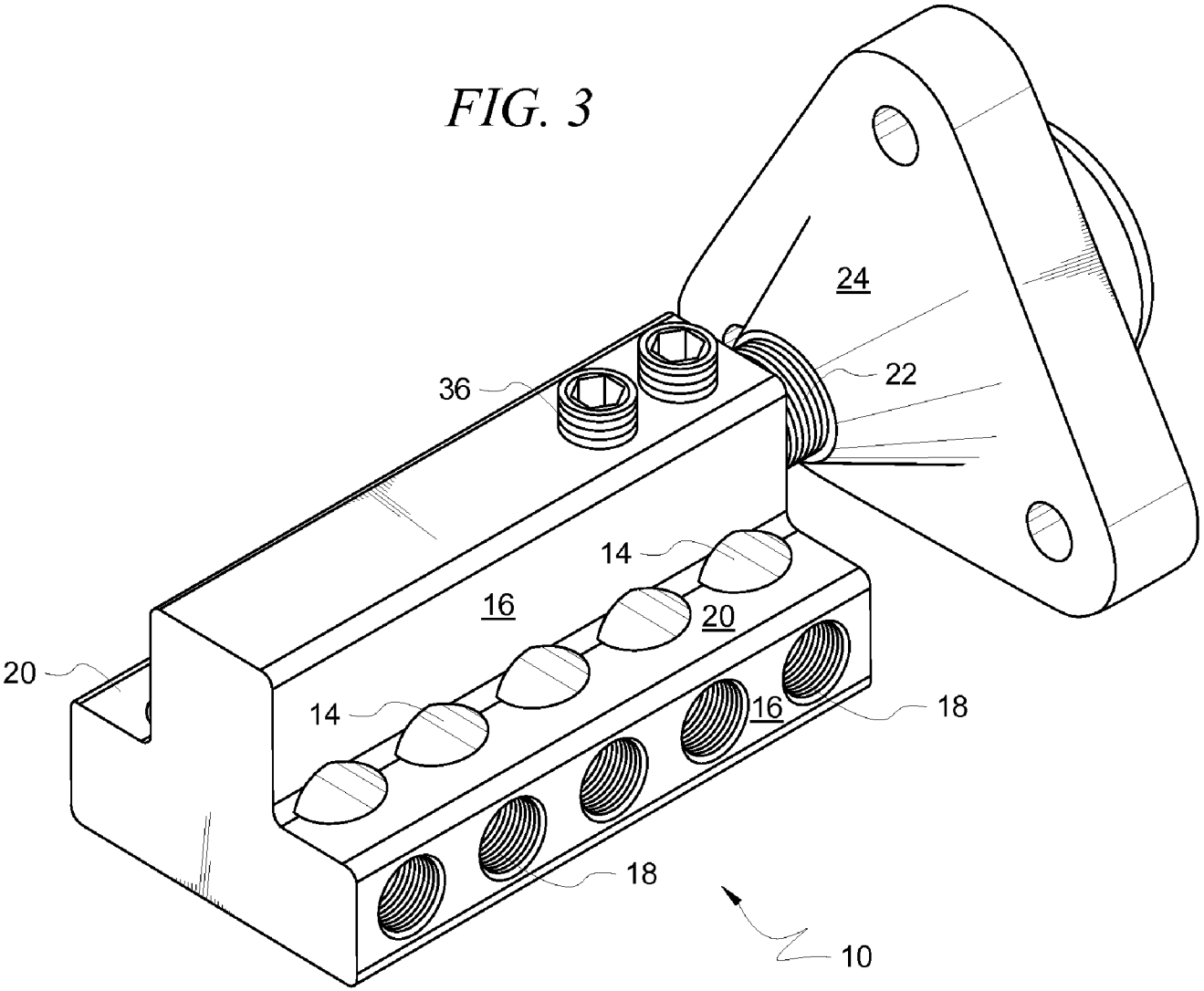
FIG. 3 is a perspective view of a third illustrative embodiment of the invention.

The stud-mounted transformer connector of FIG. 3 has a "T"-shaped lug main body so that conductors may be attached to a left side and to a right side thereof, thereby enhancing the versatility of the device. The "T"-shape also provides another way of increasing conductor-accommodating capacity without increasing the length of lug 12.

Figure 5:
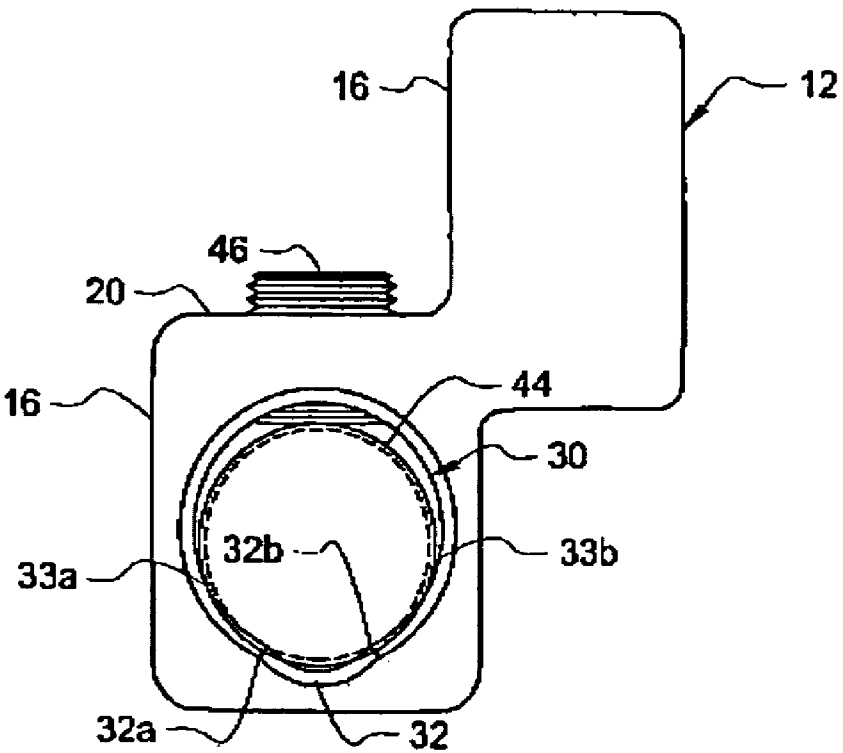
FIG. 5 is a sectional view depicting a small stud seated in an arc formed by a circular bore and held in position by a second jam screw.
Figure 4:
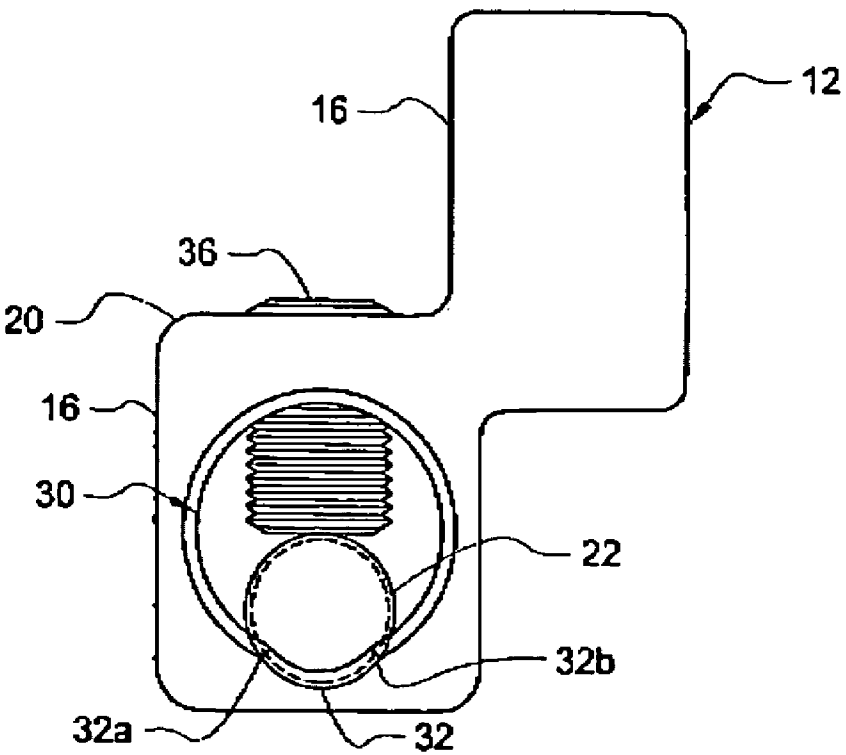
FIG. 4 is a sectional view depicting a large stud seated in a first non-circular bore and held in position by a first jam screw.

The elongate blind bore is depicted in the transverse sectional views of FIGS. 4 and 5 and is generally denoted 30 as a whole. Blind bore 30, unlike prior art bores, is not formed by machining a plurality of circular bores where each circular bore has a center spaced apart from the respective centers of the other circular bores.

After blind bore 30 is formed in lug 12, a threaded recess or circular arc is machined into the periphery of blind bore 30. The machining process removes material from lug body 12 and therefore creates an empty space in open communication with blind bore 30. The circular arc is formed by a small diameter bore of which only a short arc 32 at the bottom thereof has a physical existence when the machining process is completed. The remainder of said small diameter bore is imaginary because it is subsumed by larger blind bore 30 having a center that is eccentric relative to the center of said small diameter bore.

Short arc 32 is internally threaded and is therefore adapted to screw-theadedly receive externally threaded transformer stud 22. Such stud 22 is a small diameter stud.

As best understood in connection with FIG. 4, internally threaded circular arc 32 accommodates small diameter transformer stud 22, hereinafter to as the first externally threaded transformer stud and elongate set screw 36 secures said first externally threaded transformer stud 22 into its seated position with said internally threaded circular arc. An imaginary longitudinal axis of elongate set screw 36 bisects internally threaded circular arc 32.

As best understood in connection with FIG. 5, large bore 30 accommodates large diameter externally threaded transformer stud 44 and truncate set screw 46 secures said stud 44 into its seated position as depicted. depicted in FIG. 5. the diameter of large bore 30 is greater than the diameter of transformer stud 44. Therefore, transformer stud 44 may be inserted into said blind bore in the absence of screwthreaded engagement. However, after said non-screwthreaded insertion is accomplished. externally threaded transformer stud 44 is then brought into screwthreadcd engagement with said internally threaded blind bore. As best understood in connection with FIG. 5. after said non-screwthreaded insertion is accomplished, transformer stud 44 enters partially into the empty space created by the removal of material during the formation of circular arc 32. This partial entry or nesting of transformer stud 44 into said empty space increases die stability of the connection between connector 10 and transformer stud 44. More particularly. the nesting increases the amount of screwthreaded engagement between externally threaded transformer stud 44 and internally threaded blind bore 30. In the absence of the empty space. full screwthreaded engagement between transformer stud 44 and circular bore 30 would occur only at a point in the 6:00 position. With the empty space. as depicted in FIG. 5 full screwthreaded engagement occurs at circumiferentially spaced apart points 32*a* . 32*b* . Therefore, when an installer tightens connector 10 by rotating it relative to non-rotating transformer stud 44. such rotation can cause displacement of transformer stud 44 if it contacts blind bore 30 only at said 6:00 position but such rotation will not cause displacement of said transformer stud if it contacts blind bore 30 at said points 32*a* , 32*b* . Accordingly, said empty space increases the stability of the connection between connector 10 and transformer stud 44 as aforesaid.

Significantly , large diameter transformer stud 44 makes full screw-threaded engagement with large circular bore 30 only at two (2) points are endpoints 32*a* and 32*b* of short arc 32. The amount of screw-threaded engagement gradually reduces from said respective points of full engagement and disengagement occurs at the points denoted 33*a*, 33*b*, in *fig*. 5. The second transformer stud gradually disengages from the internal threads of the large bore due to the larger diameter of said large bore.

The bottom arc of large diameter stud 44 is unsupported between said points 32*a* and 32*b* as depicted in FIG. 5. The top or twelve o'clock position of said large diameter stud is contacted by the leading end or bottom of set screw 46. Thus, large diameter stud 44 is held securely in place by a triangulation of forces.

This is the first lug having a machined bore that includes only two circular parts and which is adapted to accommodate two transformer studs of differing diameters. Only two (2) machining steps are needed to create a large diameter circular bore for receiving a large stud and providing ample clearance space for insertion of said large stud into said large bore. The large bore has a circular arc formed in its periphery that creates a recess for receiving a small stud.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A stud mount transformer connector, comprising:

a first externally threaded transformer stud having a first diameter:

a second externally threaded transformed stud having a second diameter greater than said first diameter;

an elongate lug of solid construction having a longitudinal axis;

a plurality of conductor channels formed in said elongate lug in transverse relation to said longitudinal axis of said elongate lug;

said conductor channels being longitudinally spaced apart with respect to one another;

a plurality of set screw channels formed in said elongate lug;

said set screw channels being longitudinally spaced apart with respect to one another;

said set screw channels matching in number said conductor channels;

said set screw channels disposed in intersecting relation to said conductor channels;

an internally threaded blind bore formed in said elongate lug, said internally threaded blind bore being circular in transverse section;

said internally threaded blind bore having a diameter greater than said diameter of said second externally threaded transformer stud so that said second externally threaded transformer stud is insertable into said internally threaded blind bore a preselected extent without screwthreadedly engaging said internally threaded blind bore;

an internally threaded circular arc formed in a periphery of said internally threaded blind bore;

said internally threaded circular arc having a radius that corresponds to a radius of said first externally threaded transformer stud;

said internally threaded circular arc having a center offset from a center of said internally threaded blind bore;

said internally threaded circular arc having a longitudinal extent substantially equal to a longitudinal extent of said first externally threaded transformer stud:

said internally threaded circular arc creating an empty space in open communication with the periphery of said internally threaded blind bore, said empty space having a longitudinal extent substantially equal to a longitudinal extent of said first externally threaded transformer stud and being created by removal of material from said elongate lug when said internally threaded circular arc is formed in said periphery of said internally threaded blind bore;

said internally threaded blind bore intersecting said internally threaded circular arc at a first end of said internally threaded circular arc and at a second end of said internally threaded circular arc, said first and second ends of said internally threaded circular arc being circumferentially spaced apart from one another;

said internally threaded blind bore having a diameter sufficient to accommodate said second externally threaded transformer stud;

said first and second ends of said internally threaded circular arc adapted to support said second externally threaded transformer stud and said second externally threaded transformer stud being held in registration with said first and second ends of said internally threaded circular arc by a set screw disposed in a set screw channel that intersects said internally threaded blind bore;

said internally threaded circular arc adapted to screwthreadedly engage said first externally threaded transformer stud, thereby enhancing the stability of the engagement of the first externally threaded transformer stud and the internally threaded circular arc, said screwthreaded engagement preventing said first externally threaded transformer stud from being displaced when said screwthreaded engagement is tightened by rotating said elongate lug relative to said first externally threaded transformer stud;

said internally threaded blind bore adapted to receive said second externally threaded transformer stud having a second diameter greater than said first diameter;

said second externally threaded transformer stud extending at least partially into said empty space provided by said internally threaded circular arc, said removal of material providing a nest engageable by said second externally threaded transformer stud, there being a stable, triangular point of contact created by a set screw and opposite edges of said internally threaded circular arc, thereby enhancing the stability of the engagement of the second externally threaded transformer stud and said internally threaded blind bore because en a engagement of said nest by said second externally threaded transformer stud prevents said second externally threaded transformer stud from being displaced when a screwthreaded connection between the second externally threaded transformer stud and the elongate lug is tightened by rotating said elongate lug relative to said second externally threaded transformer stud;

said internally threaded blind bore having a diameter greater than said diameter of said first externally threaded transformer stud so that said first externally threaded transformer stud is insertable into said internally threaded blind bore a preselected extent without screwthreadedly engaging said internally threaded blind bore;

an elongate set screw for holding said first externally threaded transformer stud into screwthreaded relation with said internally threaded circular arc; and a truncate set screw for holding said second externally threaded transformer stud into screwthreaded relation with said internally threaded blind bore;

whereby only two machining steps are required to form said internally threaded blind bore and said internally threaded circular arc in said elongate lug, said two machining steps including a first step to form said internally threaded blind bore and a second step to form said internally threaded circular arc in a peripheral edge of said internally threaded blind bore;

whereby said elongate lug includes said internally threaded blind bore, said internally threaded circular arc, said plurality of conductor channels, and said plurality of set screw channels; and whereby two transformer studs of differing diameters are accommodated by said internally threaded blind bore and said internally threaded circular arc.

2. The stud mount transformer connector of claim 1, further comprising:

said internally threaded circular arc being positioned in diametrically opposed relation to an associated set screw channel so that a longitudinal axis of said truncate set screw bisects said internally threaded circular arc.

* * * * *